United States Patent [19]

Arnold

[11] 4,189,638

[45] Feb. 19, 1980

[54] WATER INJECTION PROFILING BY NUCLEAR LOGGING

[75] Inventor: Dan M. Arnold, Houston, Tex.

[73] Assignee: Texaco Inc., White Plains, N.Y.

[21] Appl. No.: 920,504

[22] Filed: Jun. 29, 1978

[51] Int. Cl.[2] ..... G01V 5/00

[52] U.S. Cl. ..... 250/259; 250/266; 250/270

[58] Field of Search ..... 250/259, 260, 264, 265, 250/266, 270

[56] References Cited

U.S. PATENT DOCUMENTS

| | | | |
|---|---|---|---|
| Re. 27,272 | 1/1972 | Young | 250/260 |
| 2,617,941 | 11/1952 | Craggs | 250/260 |
| 4,032,781 | 6/1977 | Arnold | 250/266 |
| 4,035,640 | 7/1977 | Arnold et al. | 250/265 |

*Primary Examiner*—Davis L. Willis

*Attorney, Agent, or Firm*—Carl G. Ries; Thomas H. Whaley; William J. Beard

[57] ABSTRACT

Water injection profiling of a well by nuclear logging is disclosed. A dual detector sonde with a high energy neutron source is oriented and positioned above and below perforations in the casing of an injection well to monitor upward and downward flow, respectively, of injection water. The water is irradiated by the neutron source and resulting gamma ray production is sensed as the activated water flows by the spaced detectors. Count rate data is reduced and analyzed in terms of two energy windows to obtain linear flow velocities for water flow within and behind the casing. Volume flow rates are determined for upward and downward flow, and horizontal volume flow into the surrounding formations is calculated.

12 Claims, 6 Drawing Figures

WATER INJECTION PROFILING BY NUCLEAR LOGGING

BACKGROUND OF THE INVENTION

1. Field of the Invention

The present invention relates to systems and methods for logging wells to obtain information concerning the characteristics of underground structures. More particularly, the present invention pertains to nuclear logging techniques for determining the volume flow rates and flow directions of injected water moving behind the wellbore casing.

2 Description of Prior Art

In secondary and tertiary recovery of petroleum deposits, many of the recovery techniques employ the injection of water or chemical solutions into the earth formations comprising the reservoir from injection wells. Crucial information for proper planning of such a recovery operation includes the vertical conformity of the producing formations as well as their horizontal permeability and uniformity. Such information may be obtained by an evaluation of the direction and speed of formation fluid flow by a borehole in the field. By obtaining such information at a sufficient number of boreholes throughout the filed, a mapping of the total flow throughout a petroleum reservoir may be constructed to assist in the operational planning of injection of chemicals or water in the recovery process.

U.S. Pat. No. 4,051,368 assigned to the assignee of the present invention discloses techniques for analyzing gamma ray count data obtained from activated formation fluid to reveal the horizontal flow speed of the fluid.

In such recovery operations, it is also critical to know the flow dynamics of the injected fluid through the injection well borehole and into the formations. Typically, an injection well is cased and the casing perforated at the levels of the formations into which fluid is to be injected. As fluid is pumped down the injection well, varying proportions of the fluid pass through the perforations into the different formations. The patterns of fluid flow into the various formations, including the proportion of fluid passing into each formation are affected by the permeabilities of the formations themselves. However, the fluid flow pattern is also determined in part by the presence of vertical flow passages behind the injection well casing. Such vertical flow passages may be present in the underground structure itself. However, of particular concern are channels, or voids, which occur in the cement anchoring the casing to the wall of the borehole. Injection fluid passing through the casing perforations and exposed to such vertical passages is thus diverted upwardly and/or downwardly away from the formation intended to receive the fluid. Consequently, in order to plan for the injection of predetermined amounts of fluid within individual formations and to be able to monitor such fluid injection, a fluid injection profile of each injection well is necessary.

U.S. Pat. No. 4,032,781 discusses the occurrence of such vertical fluid communication in wells, particularly production wells. Such channels as well as naturally occuring passages may communicate fluid between a water sand structure, for example, and a producing formation, or even between two producing formations. Various methods of operation are described in the U.S. Pat. No. 4,032,781 for utilizing the technique of measuring vertical fluid flow by way of nuclear logging. Such methods of operation include not only the detection of fluid flow behind the wellbore casing but also include production profiling from spaced perforations within the casing. A logging sonde designed to measure vertical underground water flow behind casing lining a borehole is disclosed. A neutron accelertor is used to irradiate the flowing water with neutrons of sufficient energy to transform oxygen in the water into unstable nitrogen 16 particles. A pair of spaced gamma ray detectors monitors the radioactive decay of the $N^{16}$ particles flowing with the water current. Linear velocity as well as volume flow rate values for the water current may be obtained by appropriately combining the measured radiation detection data.

SUMMARY OF THE INVENTION

During the injection of water in a cased well borehole, the injected water is irradiated with neutrons of 10 MEV energy or greater, and the subsequent gamma radiation from the exposed water is detected by a pair of detectors spaced along the borehole. Counting rates of the two detectors are analyzed in terms of two gamma ray energy windows. The geometry of the borehole and that of the casing are used in conjunction with the count rate data to determine the volume flow rates of water moving upwardly behind the casing, downwardly behind the casing, along the inside of the casing below the perforation, and horizontally behind the casing into the formation.

Apparatus for practicing the invention includes a sonde equipped with a neutron source and dual radiation detectors for sensing the radiation resulting from the interaction of neutrons from the neutron source with target particles in the vicinity of the sonde. The neutron source may be a neutron generator, or accelerator, of the deuterium-tritium reaction type which produces neutrons of approximately 14 MEV energy. The radiation detection system may employ any pair of appropriate gamma sensors. The two sensors are deployed along the length of the sonde, with each sensor at a different measured distance from the neutron source. Appropriate shielding is interposed between the sensors and the neutron source to prevent direct bombardment of the sensors. The sonde is suspended from the ground surface by an appropriate line or cable and connected to surface control and data reduction equipment by appropriate electrical connectors, which may be included as part of the supporting cable.

The total volume flow rate of water injected into the well is determined by measuring the water injection rate at the surface, or by using known nuclear logging techniques for measuring flow within the casing as described in U.S. Pat. No. 4,032,781. The sonde is structured and oriented with the detectors below the level of the source, and is positioned just below a perforation in the casing at which the fluid flow is to be analyzed. The injected water is irradiated and gamma ray counts acquired by use of the detectors, and analyzed in terms of the two gamma ray energy windows. The linear velocity of the fluid flow downwardly within the casing just below the perforation in question is calculated using the analyzed count rate data.

Similarly, the linear downward flow velocity of the water behind the casing just below the perforation is calculated based on the count rate data. These values of the linear downward velocity flow within and behind the casing are then used to separate the count rate data of one of the detectors, and within one of the selected energy windows, to identify the separate contributions to the count rate from water flowing within as well as behind the casing. With the count rate contributions thus identified, the volume flow rate of water flowing downwardly within the casing just below the perforation, as well as the volume flow rate of water flowing downwardly behind the casing just below the perforation, may be determined.

The sonde is then reoriented and repositioned for upward flow measurement. Thus, the sonde is positioned just above the perforation in question and oriented with the two detectors above the neutron source. The flowing injected water is again irradiated and resulting gamma radiation detected and analyzed as a function of the two gamma ray energy windows. The upward volume flow rate for water moving behind the casing is then calculated according to the technique used for determining downward flow, utilizing the fact that there is no upward flow within the casing. By comparing the volume flow rates thus determined for water flowing into the well, upwardly behind the casing above a perforation, downwardly behind the casing below the perforation, and downwardly within the casing just below the perforation, the volume flow rate of injected water moving horizontally into the formation at the perforation can then be determined.

Where multiple perforations in a cased well are to be examined, the sonde may be positioned, say, below each perforation in turn with the sonde orientation selected to measure downward fluid flow velocity. Thus, all of the downward flow data may be acquired for all perforations in one trip of the sonde down the well. At each perforation, the total downward volume flow rate of fluid just above the perforation and within the casing is given by the downward volume flow rate within the casing as determined just below the perforation immediately above the perforation being examined. The sonde may be retrieved and oriented for upward flow measurement. Then, in a single trip down the well, the sonde may be positioned for measuring upward water flow just above each perforation in turn. In this way, complete data acqusition for water injection profiling of a multiple-perforation well may be accomplished in just two trips down the well.

DESCRIPTION OF PREFERRED EMBODIMENTS

Figure 1:
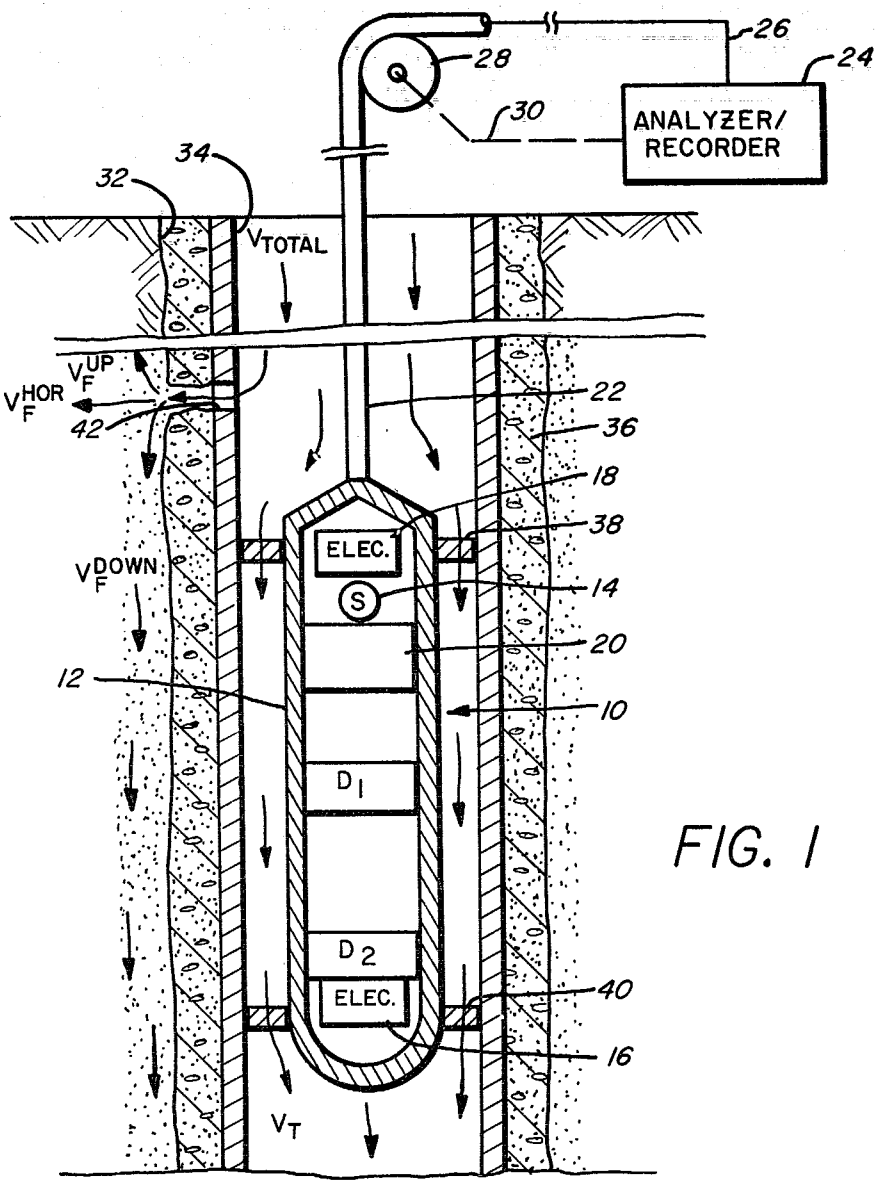
FIG. 1 is a schematic representation showing the essential features of a logging sonde for practicing the present invention, suspended within a cased well borehole, and illustrating possible injected fluid flow.

A downhole sonde for water injection profiling is shown schematically at 10 in FIG. 1. A fluid-tight housing 12 contains a neutron source 14 and a pair of gamma ray detectors D1 and D2 sequentially spaced from the neutron source 14 as shown. Necessary downhole electronic circuitry 16 is included to meet the power supply requirements of the detectors and to provide amplification of their output signals. The gamma ray detectors D1 and D2 may be of any appropriate type, such as scintillation counters well known in the art. It will be appreciated that the nature of the associated electronic circuitry 16 will be dictated in part by the choice of detectors D1 and D2.

The neutron source 14 is also provided with its own power supply and triggering circuitry 18. The neutron source 14 produces neutrons capable of reacting with the oxygen 16 particles in the injected water to produce the unstable isotope nitrogen 16, the reaction being $O^{16}(n,p)N^{16}$. The source 14 may be a neutron generator, or accelerator, of the deutrium-tritium reaction type which produces neutrons of approximately 14 MEV energy. Upon the capture of such a high energy neutron, an oxygen 16 nucleus is transmutted to radioactive nitrogen 16. The radioactive nitrogen 16 decays with a half life of about 7.1 seconds by the emission of a beta particle and high energy gamma rays having energies of approximately 6 MEV or more. A neutron generator is capable of providing the high energy neutrons in sufficiently high flux to produce enough radioactive nitrogen 16 particles in the injected water to allow the irradiated water flow to be detected by the spaced detectors D1 and D2.

Shielding 20 separates the neutron source 14 from the detectors D1 and D2 to prevent the detectors from being irradiated directly by the neutron source or radiation induced by neutron scatter in the immediate vicinity of the source.

The sonde 10 is suspended by an armoured cable 22 which leads to the well surface. The cable 22 not only supports the sonde 10, but also encompasses a protective shield for electrical conductors leading from appropriate instrumentation at the surface to the various components within the sonde. Such surface instrumentation is represented schematically in FIG. 1 by an analyzer/recorder 24 shown connected to the cable 22 by a conductor 26, it being understood that additional, known surface equipment is involved. Further, the supporting cable 22 is illustrated as passing over a sheave 28 schematically joined to the analyzer/recorder 24 by a connector 30. Thus, the location of the sonde in the well may be monitored by use of the sheave 28. The data signals from the two detectors D1 and D2 may then be analyzed and related to the well level at which the count data was acquired, and the results recorded.

Additional details of a dual detector neutron source sonde and related surface electronics for data analysis are disclosed in the aforementioned U.S. Pat. No. 4,032,781. Further, the advantages of operating the neutron source and detectors in a pulsed mode rather than a continuous mode are described in the U.S. Pat. No. 4,032,781. Except as required for clarity, such details of apparatus and data processing techniques, being known in the art, will not be described in further detail herein.

The sonde 10 is shown in FIG. 1 suspended by the cable 22 within a well 32 lined with casing 34 anchored in place by cement 36. Centralizers 38 and 40 are fixed to the sonde housing 12 to maintain the sonde centered within the casing 34.

A portion of the injected water may be diverted at each casing perforation to flow behind the casing horizontally, upwardly and/or downwardly. The possible flow of injected water is indicated in FIGS. 1-3 by the patterns of arrows, and the flow components identified as:

- $V_T$=the total volume flow rate of injection water flowing downwardly within the casing below a given perforation;
- $V_F^{DOWN}$=the volume flow rate of water flowing downwardly behind the casing just below a given perforation;
- $V_F^{UP}$=the volume flow rate of water flowing upwardly behind the casing just above a given perforation;
- $V_F^{HOR}$=the volume flow rate of water flowing horizontally into a formation at the level of a given perforation; and
- $V_{TOTAL}$=the total volume flow rate of injection water flowing within the casing just above a given perforation and, for the highest perforation, is the volume flow rate of water injected into the well at the surface.

Figure 2:
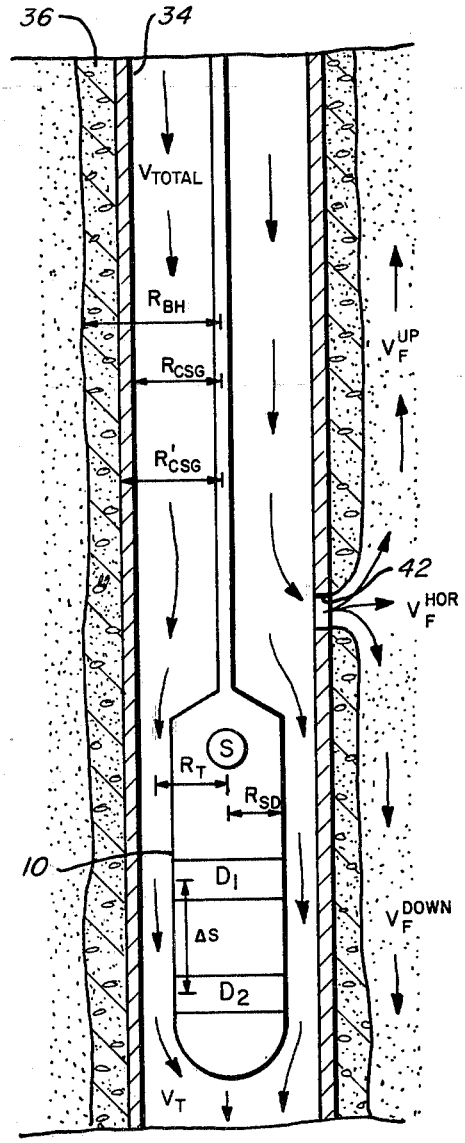
FIG. 2 further details the positioning of the sonde for obtaining downward flow data.

In FIG. 2, the sonde 10 is schematically shown positioned below the casing perforation 42. Certain distances descriptive of the geometry of the casing and borehole are marked off in FIG. 2 and described in detail hereinafter.

Figure 3:
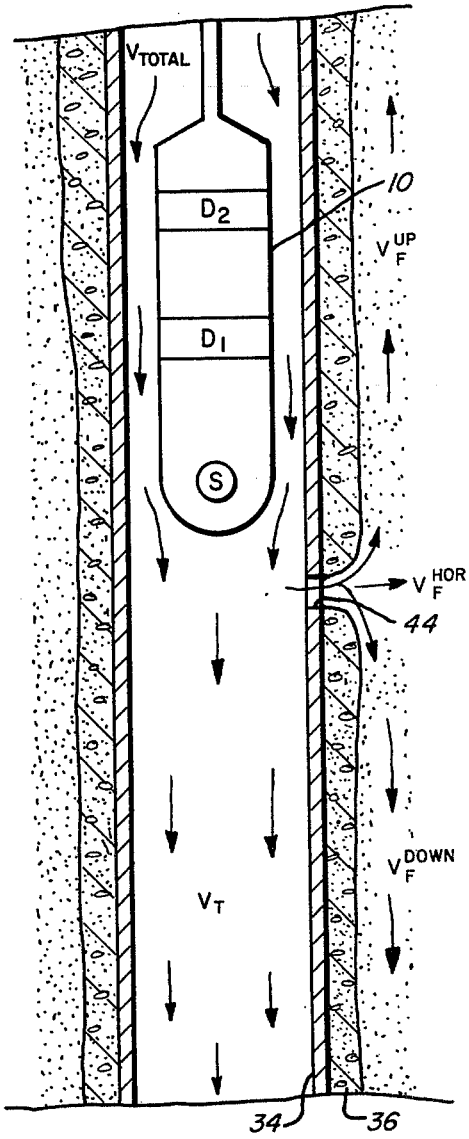
FIG. 3 illustrates the positioning and orientation of the sonde for upward flow measurements.

FIG. 3 shows the orientation of the source and detectors within the sonde 10 when the sonde is positioned above a casing perforation 44 for data acquisition purposes. When upward fluid flow is to be monitored, the source is positioned below the detectors as in FIG. 3. Thus, the configuration of FIG. 3 is utilized in monitoring the upward fluid flow behind the casing. To monitor downward fluid flow, both within and behind the casing, the configuration of FIG. 2 is utilized in which the sonde is positioned below the perforation through which fluid is communicated beyond the casing, and the detectors are below the source. Thus, in each case, the fluid whose movement is being monitored passes first laterally opposite the source 14 for irradiation purposes, then moves by the detectors D1 and D2 for sensing purposes.

To enable the same sonde 10 to be used for both downward and upward flow measurements, the sonde 10 may be of modular construction. Thus, the sonde may be partially dismantled to invert the detector and source portion to change between the configurations shown in FIGS. 2 and 3. Further discussion of the construction and use of such a modular sonde may be found in the aforementioned U.S. Pat. No. 4,032,781.

Figure 6:
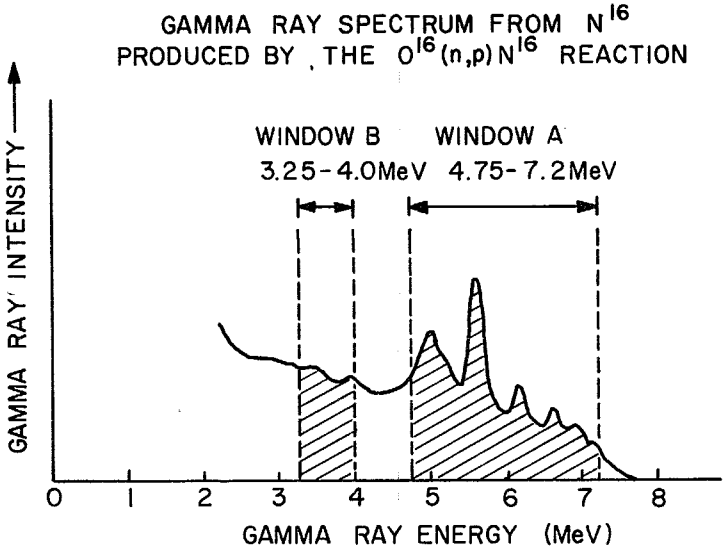
FIG. 6 is a graphical representation of the gamma ray spectrum generated for use in the logging operation, indicating two energy windows.

FIG. 6 shows a gamma ray spectrum from the $O^{16}(n,p)N^{16}$ reaction that may be detected by the detectors D1 and D2. The double-ended arrows identify two energy windows A and B, respectively. Data from the detectors is analyzed in terms of energy windows A and B, counts for all other gamma ray energies being deleted in the data analysis operation. Window A includes the 7.12 and 6.3 MEV primary radiation peaks occurring in the decay of the nitrogen 16 isotope. Gamma rays of these energies reach the detectors D1 and D2 directly. Energy window B includes energies of gamma rays resulting from collisions, primarily of the Compton scattering type, of the primary radiation with material lying between the gamma-producing particles and the detectors.

If $C_A(R)$ s defined as the count rate recorded in window A for gamma rays produced at a dstance R from a detector, and $C_B(R)$ is the count rate recorded in window B for the same distance R, it can be shown that:

$$C_A(R_2)/C_B(R_2) < C_A(R_1)/C_B(R_1) \quad \text{for } R_2 > R_1 \qquad (1)$$

where $R_1$ and $R_2$ are such distances from the detector to the decaying particles. The ratio inequalities $C_A/C_B$ in equation 1 which result in this manner are due to the fact that a large fraction of the primary 6.13 and 7.12 MEV gamma radiation is degraded by collisions with the intervening material as the distance R between the decaying particles and the detector is increased. Thus, by calibrating a system of water flow detection in terms of the spectral degradation as a function of the radial distance R, a tool is provided for determining the unknown radial distance R to the center of irradiated fluid flow.

Figure 4:
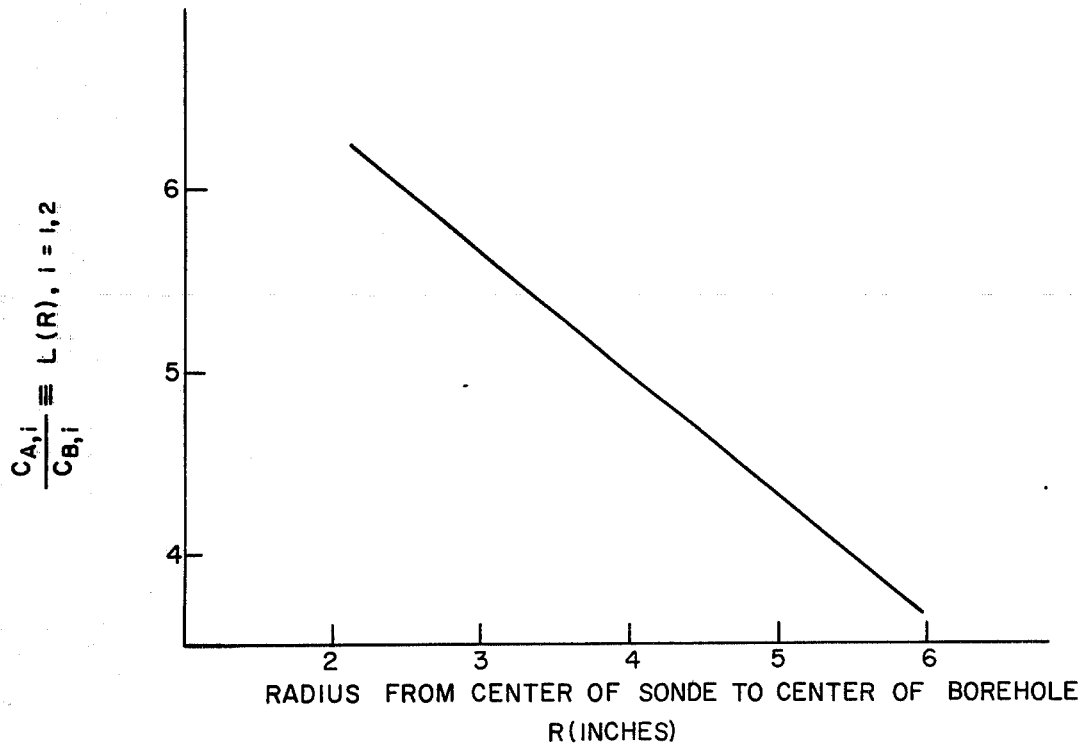
FIG. 4 is a graphical representation showing the count rate ratio of two energy windows for a single detector as a function of distance from the center of the sonde to the center of the flow.

It can be shown by experimentation as well as monte carlo calculations that the ratio of counting rates $C_A/C_B$ for a single detector as a function of the distance R is essentially linear as shown in FIG. 4. This functional relationship between the ratio of counting rates for a single counter counting in the two windows A and B is defined as L(R). Further discussion of the use of the gamma ray spectral degradation technique to determine R appears in the aforementioned U.S. Pat. No. 4,032,781.

To obtain the necessary count rate data to profile the water injection characteristics of an injection well perforated at one or more levels, the sonde 10 may first be positioned just below the top perforation as shown in FIG. 2. With the detectors D1 and D2 below the source, the sonde is in configuration for monitoring the downward flow of water both within and behind the casing 34. The source is pulsed to provide the necessary neutron radiation to transmute the oxygen 16 particles in the water flowing downwardly both within and behind the casing, thereby generating unstable nitrogen 16 particles. As the irradiated water flows down by the sonde 10, the detectors D1 and D2 are activated to sense the emmitted gamma rays. The surface circuitry analyzes the count rate in terms of the two detectors D1 and D2, with the count rate data further distinguished as to the two energy windows A and B.

To monitor upward flow of injection water passing behind the casing above a perforation, the sonde is positioned above the perforation and oriented with the detectors above the source as shown in FIG. 3. The same method of operation of the neutron source and detectors is followed as in the case of the downward flow monitoring. Thus, the irradiated injection water moves along the sonde but behind the casing whereupon the emmitted gamma rays are sensed by the detectors D1 and D2. Analysis of the count rate data is made in terms of the two detectors as well as the two windows A and B.

Before the count rate data may be completely analyzed to determine the volume flow rates of the injected water in the various directions possible, the total volume flow rate of water within the casing above the top perforation, $V_{TOTAL}$, is determined by metering the injection rate of the water at the surface. An alternate method of determining this value of the downward volume flow rate involves the use of the sonde 10 for flow measurements within the casing as described in the aforementioned U.S. Pat. No. 4,032,781.

For monitoring of water flow at the next lower perforation, the value of $V_T$ from just below the highest perforation is taken as $V_{TOTAL}$. Then $V_{TOTAL}$ at each subsequent perforation monitoring is given by $V_T$ from the perforation immediately above.

As indicated in FIG. 2, $R_T$ is the distance from the center of the sonde to the center of the annular region between the outer surface of the sonde and the inner surface of the casing 34. The value of $R_T$ may be computed from the equation $$R_T=(R_{CSG}=R_{SD})/2 \tag{2}$$

where $R_{CSG}$ is the known inner radius of the casing 34, and $R_{SD}$ is the known outer radius of the sonde 10.

$R_F$ is the distance from the center of the sonde 10 to the center of the flow behind the casing. It is anticipated that the flow behind the casing will be centered within the cement lining 36. Where there is horizontal fluid flow within the formation surrounding the perforation, that is, $V_F^{HOR}\neq 0$, a value of $R_F$ must be obtained. Assuming that the flow behind the casing is centered within the annular cement structure 36, equation 3 may be assumed:

$$R_F=(R_{BH}-R_{CGS}')/2 \tag{3}$$

where $R_{BH}$ is the radius of the borehole 32, and $R_{CSG}'$ is the known outside radius of the casing 34. The borehole radius $R_{BH}$ may be obtained from a conventional caliper log of the well, or from the size of the drill bit used to drill the injection well.

With the parameters thus determined, the values for $V_F^{DOWN}, V_T, V_F^{UP}$ and $V_F^{HOR}$ may be evaluated in relation to the injection water flow at each perforation level in the cased well by securing and reducing count rate data as follows.

With the sonde configured to measure flow in the downward direction and positioned immediately below the first perforation, the linear velocity of downward flow behind the casing, $v_F$, and the linear velocity of the water flowing within the casing $v_T$, may be obtained by use of the following count rate data:

$C_{A,1}$=count rate of detector D1 for gamma rays within window A;

$C_{B,1}$=count rate of detector D1 for gamma rays within window B;

$C_{A,2}$=count rate of detector D2 for gamma rays within window A; and $C_{B,2}$=count rate of detector D2 for gamma rays within window B.

The count rate for each detector within a given energy window is, in general, composed of count rate contributions from irridated fluid flowing within the casing as well as behind the casing. Thus, $$C_{A,1}=C_{A,1}^T+C_{A,1}^F \tag{4}$$

where $C_{A,1}^T$ is the contribution from water flowing within the casing, and $C_{A,1}^F$ is the contribution from the flow behind the casing. Similarly, $$C_{A,2}=C_{A,2}^T+C_{A,2}^F \tag{5}$$

where $C_{A,2}^T$ and $C_{A,2}^F$ are the contributions from flow within and behind the casing, respectively. Corresponding equations may be written for the contributions to the count rates for each detector for the energy window B. It can be shown that:

$$C_{A,1}^T/C_{A,2}^T=e^{K/vT}, \tag{6}$$

and $$C_{A,1}^F/C_{A,2}^F=e^{K/vF} \tag{7}$$

where $k=\lambda\Delta S$, where $\lambda$ is the decay consant of $N^{16}$, and $\Delta S$ is the spacing between the detectors D1 and D2 as indicated in FIG. 2. Combining equations 4 through 7 yields:

$$C_{A,1}=C_{A,2}e^{K/vT}-C_{A,2}^F(e^{K/vT}-e^{K/vF}). \tag{8}$$

Similarly:

$$C_{B,1}=C_{B,2}e^{K/vT}-C_{B,2}^F(e^{K/vT}-e^{K/vF}). \tag{9}$$

From the relationship as indicated in FIG. 4, $$C_{A,2}^F/C_{B,2}^F=L(R_F) \tag{10}$$

for detector D2 downward flow. It can then be shown that:

$$C_{A,2}^F=C_{B,1}^F L(R_F)e^{-K/vF}. \tag{11}$$

Combining equations 8, 9, and 11, and the relationship $$C_{B,2}^F=C_{B,1}^F e^{K/vF} \tag{12}$$

yields the following expression for the linear downward flow velocity within the casing:

$$v_T=K/1n[(C_{A,1}-C_{B,1}L(R_F))/(C_{A,2}-C_{B,2}L(R_F))] \tag{13}$$

where all of the factors on the right side of equation (13) are either known, ascertainable from count rate data, or obtainable by use of the relationship indicated in the graph of FIG. 4.

Similarly, the following expression for the linear downward flow rate for injected water below the perforation and behind the casing may be developed:

$$v_F=k/1n[(C_{A,1}-C_{B,1}L(R_T))/(C_{A,2}-C_{B,2}L(R_T))] \tag{14}$$

where the values on the right side of equation (14) are either known or determinable.

From equations (7) and (8), the count rate contribution for energy window A and detector D1 from fluid flow behind the casing may be obtained as follows:

$$C_{A,1}^F=[(C_{A,1}-C_{A,2}e^{K/vT})/(e^{K/vF}-e^{K/vT})]\ e^{K/vF}. \tag{15}$$

Similarly, the corresponding contribution from downward flow within the casing may be found as:

$$C_{A,1}^T=[(C_{A,1}-C_{A,2}e^{K/vF})/(e^{K/vT}-e^{K/vF})]\ e^{K/vT}. \tag{16}$$

All of the terms on the right sides of equations (15) and (16) are either known, obtainable from count rate data, or can be calculated using equations (13) and (14).

Figure 5:
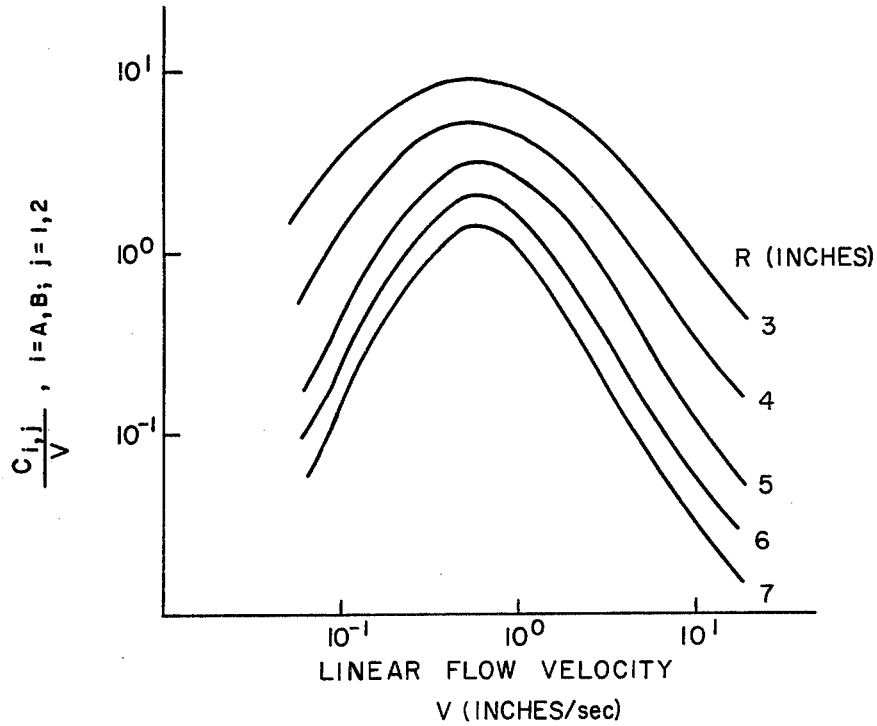
FIG. 5 is a graphical representation showing the relationship between the ratio of a single-window count rate at one detector to the volume flow rate and the corresponding linear flow velocity for several values of distance from the detector.

The relationship between a single window, single detector count rate and the linear flow velocity for the radioactive fluid is represented in FIG. 5 in terms of the corresponding volume flow rate and for several distances between the location of the fluid flow center and the detector. Using the assumed value of $R_F$, the value of the linear flow velocity $v_F$ from equation (14), and the count rate $C_{A,1}^F$ as calculated from equation (15), the value for the volume flow rate of fluid flowing downwardly behind the casing and below the first perforation, $V_F^{DOWN}$, may be determined from the relationship indicated in FIG. 5. Similarly, using the computed value of $R_T$, the value of the linear flow velocity $v_T$ obtained from equation (13), and the count rate $C_{A,1}^T$ calculated from equation (16), the value of the volume flow rate of fluid moving downwardly within the casing below the first perforation, $V_T$, may be obtained with the use of the relationship of FIG. 5. Corresponding expressions for window B count rates, and/or detector D2 count rates, may be used for these determinations of $V_F^{DOWN}$ and $V_T$ rather than equations (15) and (16), respectively.

The sonde 10 may be reconfigured and repositioned above the perforation, as illustrated in FIG. 3, and the value of the volume flow rate of fluid moving upwardly behind the casing and above the perforation, $V_T^{UP}$, may be obtained by the same technique used for finding the downward volume flow rates, recalling that there is no upward flow within the casing above the perforation. Thus, $C_{A,1}^T$, $C_{A,2}^T$, $C_{B,1}^T$ and $C_{B,2}^T$ are all zero for upward flow. The sonde is positioned immediately above the perforation of interest for this measurement.

The value of the volume flow rate of fluid moving horizontally away from the perforation of interest may now be obtained from quation (17):

$$V_F^{HOR} = V_{TOTAL} - V_T - V_F^{UP} - V_F^{DOWN}. \quad (17)$$

It will be noted that the value of $R_F$ was utilized hereinbefore for obtaining the downward flow velocity within the casing, $v_T$, only. If it is found that there is no horizontal fluid flow into the formation, that is, $V_F^{HOR}=0$, the value of $R_F$ can be obtained by use of equation 17 and the relationship of FIG. 5. It will also be appreciated that, with the sonde appropriately positioned and configured as indicated in FIGS. 2 and 3, observed responses of the near and far detector count rates, $C_1$ and $C_2$, respectively, also serve as indicators of whether $V_F^{UP}$ and/or $V_F^{DOWN}$ are 0.

If additional perforations are to be examined, the sonde is positioned below the second perforation, and $V_{TOTAL}$ is set equal to the previous value of $V_T$. Then, the previous steps for determining the various volume flow rates are repeated. As noted hereinbefore, all of the downward flow measurements can be made sequentially in a single trip down the well by simply positioning the sonde for data acquisition below each succeeding perforation. Similarly, all the upward flow measurements may be made sequentially in a single trip by appropriately positioning the sonde above each perforation in turn. For each perforation to be examined, the value of $V_{TOTAL}$ is set equal to the value $V_T$ determined for the next highest perforation.

The present invention provides techniques for constructing a water injection profile for a perforated cased well with any number of perforations. By monitoring the flow of injected water within the casing as well as behind the casing in the vicinity of, say, each perforation, the proportion of the injected fluid reaching each of the perforation levels within the well may be ascertained. Further, where water flow channels are present along the cement lining of the borehole, the percentage of injected fluid moving horizontally into the nearby formations may be determined. In this way, a rather complete picture may be obtained of the disposition of the injection water forced into the well as distributed by the particular injection well into the surrounding formations, and the effectiveness of the injection operation evaluated.

The foregoing disclosure and description of the invention is illustrative and explanatory thereof, and various changes in the method steps as well as in the details of the illustrated methods may be made within the scope of the appended claims without departing from the spirit of the invention.

I claim:

1. A method for determining the characteristics of flow of injection water in and beyond a known size cased well borehole having casing perforations at one or more levels within the well comprising the following steps:

(a) providing a well tool having a source of radiation and at least two detectors longitudinally spaced from said source and each other;

(b) positioning said well tool below a level of casing perforations with said radiation source above said detectors;

(c) irradiating the borehole environs, including injection water being forced into the borehole, by radiation from said radiation source;

(d) detecting radiation from the activated injection water by operation of said detectors and generating signals representative thereof;

(e) distinguishing count rate data from each of said detectors according to two energy ranges of detected radiation;

(f) combining said count rate data according to a first predetermined relationship to derive an indication of the linear flow rate of said activated injection water downwardly within said casing below said perforation level;

(g) combining said count rate data according to a second predetermined relationship to derive an indication of the linear flow rate of said activated injection water downwardly behind said casing below said perforation level;

(h) positioning said well tool above said level of casing perforations with said radiation source below said detectors, and repeating steps (c) through (e); and (i) combining said count rate data according to said second predetermined relationship to derive an indication of the linear flow rate of said activated injection water upwardly behind said casing above said perforation level.

2. A method as defined in claim 1 further comprising the additional steps of combining each of said linear flow rates for flow downwardly within said casing, downwardly behind said casing, and upwardly behind said casing with a third predetermined relationship to obtain indications of the volume flow rate of injection water downwardly within said casing below said perforation level, the volume flow rate of injection water downwardly behind said casing, and the volume flow rate of injection water upwardly behind said casing.

3. A method as defined in claim 2 further comprising the additional step of combining said volume flow rates with the volume flow rate of injection water downwardly within said casing just above said perforation level to obtain an indication of the volume flow rate of injection water into the formation surrounding said borehole at the perforation level.

4. A method as defined in claim 3 further comprising repeating the steps of claims 1 through 3 for additional perforation levels of said injection well.

5. A method as defined in claim 4 wherein all steps (c) and (d) of claim 1 are carried out with said well tool positioned, and oriented with said radiation source above said detectors, for acquisition of count rate data corresponding to downward flow rates below perforation levels in a single trip of said well tool in said borehole, and all steps (c) and (d) of claim 1 are carried out with said well tool positioned, and oriented with said radiation source below said detectors, for acquisition of count rate data corresponding to upward flow rates above perforation levels in a single trip of said well tool in said borehole.

6. A method as defined in claim 1 further comprising repeating the steps of claim 1 for each additional perforation level of said injection well.

7. A method as defined in claim 1 wherein said neutron source provides neutrons of sufficiently high energy to cause the nuclear reaction $O^{16}(n,p)N^{16}$ in said injection water, said detectors are gamma ray detectors, and said activated injection water generates gamma rays from said $N^{16}$ particles produced therein, which gamma rays may be detected by said detectors.

8. A method for determining the characteristics of flow of injection water in and beyond a known size cased well borehole having casing perforations at one or more levels within the well comprising the following steps:

(a) providing a well tool having a source of high energy neutrons having sufficient energy to cause the nuclear reaction $O^{16}(n,p)N^{16}$ and at least two gamma ray detectors longitudinally spaced from said source and each other;

(b) positioning said well tool below a perforation level with said detectors below said source in a down-flow configuration, and positioning said well tool above a perforation level with said detectors above said source in an up-flow configuration;

(c) with said well tool in said down-flow configuration and in said up-flow configuration, repetitively irradiating the borehole environs, including said injection water being forced into said well, with bursts of high energy neutrons from said source and detecting, subsequent to each neutron burst, at each of said detector gamma rays caused by the decay of the unstable isotope nitrogen 16 and generating signals representative thereof;

(d) distinguishing count rate data from each of said detectors according to two energy ranges of detected gamma rays;

(e) combining said count rate data, acquired with said well tool in said down-flow configuration, according to a first predetermined relationship to derive an indication of the linear flow rate of injection water flowing downwardly within said casing below said perforation level, and according to a second predetermined relationship to derive an indication of the linear flow rate of injection water flowing downwardly behind said casing below said perforation level; and (f) combining said count rate data, acquired with said well tool in said up-flow configuration, according to said second predetermined relationship to derive an indication of the linear flow rate of injection water flowing upwardly behind said casing above said perforation level.

9. A method as defined in claim 8 further comprising the additional steps of combining each of said linear flow rates for flow downwardly within said casing, downwardly behind said casing, and upwardly behind said casing with a third predetermined relationship to obtain indications of the volume flow rate of injection water downwardly within said casing below said perforation level, the volume flow rate of injection water downwardly behind said casing, and the volume flow rate of injection water upwardly behind said casing.

10. A method as defined in claim 9 further comprising the additional step of combining said volume flow rates with the volume flow rate of injection water downwardly within said casing just above said perforation level to obtain an indication of the volume flow rate of injection water into the formation surrounding said borehole at the perforation level.

11. A method as defined in claim 10 further comprising repeating the steps of claims 8 through 10 for additional perforation levels of said injection well.

12. A method as defined in claim 8, further comprising the additional steps of carrying out the steps of claim 1 for all additional perforation levels of said injection well wherein all data is acquired with said well tool in down-flow configuration in a single trip of said well tool in said well, and all data is acquired with said well tool in up-flow configuration in a single trip of said well tool in said well.

* * * * *